US006401562B1

(12) United States Patent
De' Stefani

(10) Patent No.: US 6,401,562 B1
(45) Date of Patent: Jun. 11, 2002

(54) METHOD FOR PRODUCING GEAR WHEELS FROM BLANKS OBTAINED BY SINTERING METAL POWDERS

(75) Inventor: Vincenzo De' Stefani, Padova (IT)

(73) Assignee: M.G. Mini Gears S.p.A., Padova (IT)

( * ) Notice: Subject to any disclaimer, the term of this patent is extended or adjusted under 35 U.S.C. 154(b) by 0 days.

(21) Appl. No.: 09/592,557

(22) Filed: Jun. 12, 2000

(30) Foreign Application Priority Data

Jun. 22, 1999 (IT) ..... PD99A0133

(51) Int. Cl.[7] ..... F16H 55/06

(52) U.S. Cl. ..... 74/462; 75/356

(58) Field of Search ..... 74/462, 460, 457, 74/421 R; 75/330, 356

(56) References Cited

U.S. PATENT DOCUMENTS

RE28,696 E * 1/1976 Rouverol ..... 74/462
4,677,870 A * 7/1987 Alshareedah ..... 74/431
6,148,685 A * 11/2000 Cadle et al. ..... 74/457

FOREIGN PATENT DOCUMENTS

JP 2-21054 * 1/1990

* cited by examiner

*Primary Examiner*—David Fenstermacher
(74) *Attorney, Agent, or Firm*—Guido Modiano; Albert Josif; Daniel O'Byrne

(57) ABSTRACT

A method for producing gear wheels from blanks obtained by sintering metal powders, comprising the step of coining longitudinal and transverse profiles of the teeth of a sintered blank with a rolling operation by one or more rollers shaped complementarily to the blank with a profile which is adapted to produce modifications of the profiles.

4 Claims, 1 Drawing Sheet

METHOD FOR PRODUCING GEAR WHEELS FROM BLANKS OBTAINED BY SINTERING METAL POWDERS

BACKGROUND OF THE INVENTION

The present invention relates to a method for producing gear wheels from blanks obtained by sintering metal powders.

Gear wheels obtained from sintered metal powders are already known.

In particular, GB-1,125,952 discloses a method for producing gear wheels from sintered metal powders which entails, after forming a blank by sintering, the rolling of the teeth in order to give the correct size to the profiles.

Blanks with straight teeth are obtained in simple dies by pressing and sintering, while blanks with helical teeth are formed in more complex dies with a profile which is already spiral-shaped.

Rolling is then performed with complementarily shaped toothed rollers, provided with straight teeth in the former case and with helical teeth in the latter case, in order to give the correct size to the teeth, as mentioned.

Moreover, it is known from EP-552,272 to provide gear wheels by means of sintering and subsequent rolling.

The latter step is aimed at compressing the outer surface of the teeth in order to harden it and make the gear wheels adapted for power transmission instead of low-stress transmission applications.

Also in this case, the blank obtained by sintering has teeth in their final configuration, albeit with enlarged dimensions, which must be subjected to compression.

Currently, therefore, it is believed that after formation by sintering, i.e., compaction of metal powders and subsequent heating in an oven, it is possible to obtain gear wheels only by means of rolling operations which give the correct dimensions to the profile of the teeth or compress the profile in order to harden it.

After formation by sintering, the profile of the teeth already has the final shape, but its dimensions are larger than in the final product.

SUMMARY OF THE INVENTION

The aim of the present invention is to provide a method which allows to provide gear wheels from blanks obtained by sintering metal powders and allows to correct the longitudinal profile of the teeth.

Within the scope of the this aim, an object of the present invention is to provide a method which allows to produce gear wheels with tooth corrections similar to those having a ground profile starting from straight-tooth blanks.

This aim, this object and others which will become better apparent hereinafter are achieved by a method for producing gear wheels from blanks obtained by sintering metal powders, which comprises the step of:

coining longitudinal and transverse profiles of teeth of a blank with straight or helical teeth with a rolling operation by means of one or more rollers shaped complementarily to said blank with a profile which is adapted to produce modifications of said longitudinal and transverse profiles.

BRIEF DESCRIPTION OF THE DRAWINGS

Further characteristics and advantages of the present invention will become better apparent from the following detailed description of operating steps thereof described hereinafter and from the accompanying drawings, wherein.

DESCRIPTION OF THE PREFERRED EMBODIMENTS

The method according to the invention, with reference to the above figures, consists in forming straight-toothed blanks 10 by compaction from metal powders and by subsequent heating in an oven.

By using one or more rollers having a profile which is shaped complementarily but has appropriate slight modifications with respect to the profile of each blank 10 and with a "crown", i.e., a modification of the longitudinal profile of each tooth, coining is performed by pressing the roller or rollers on the flanks of the blank while turning so as to gradually and uniformly apply a deformation to the entire set of teeth.

Figure 1:
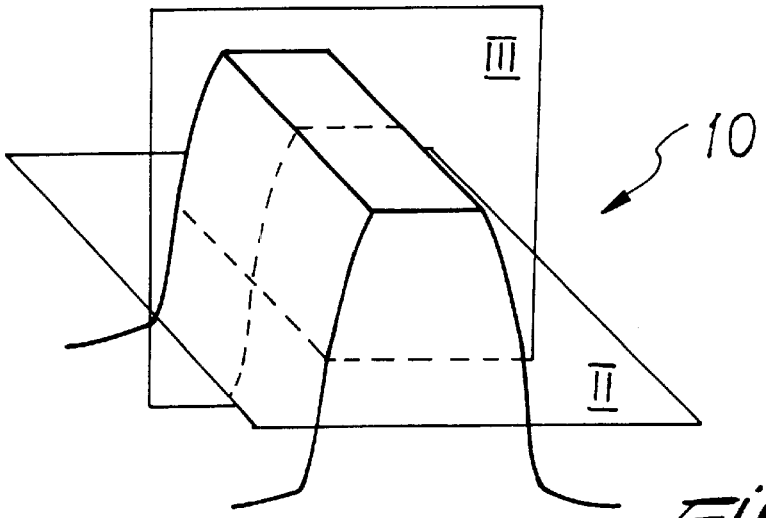
FIG. 1 is a perspective view of a tooth with an involute profile before rolling.
Figure 2:
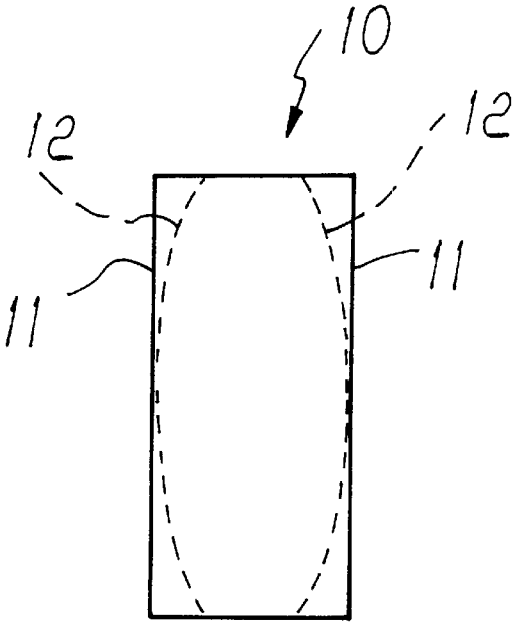
FIG. 2 is a sectional view, taken along the plane II of FIG. 1, with the coining profile shown in dashed lines.
Figure 3:
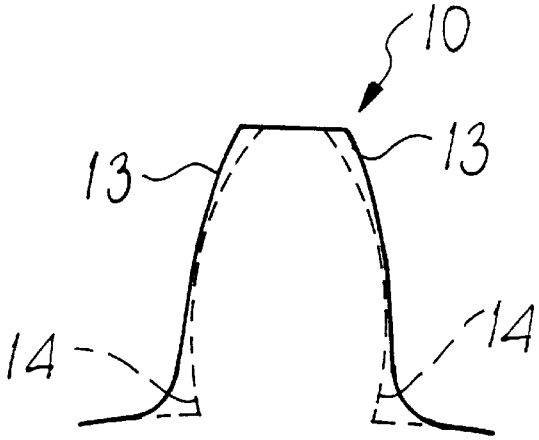
FIG. 3 is a sectional view, taken along the plane III of FIG. 1, with the coining profile shown in dashed lines.

The end result generates the intended shape of the longitudinal profile (which changes from the outline 11 to the outline 12 of FIG. 2) and of the transverse profile (which changes from the outline 13 to the outline 14 of FIG. 3) of the teeth and therefore produces the final product.

Both profiles of the teeth are modified (crowned) by the applied deformation in order to obtain better meshing.

The rolling operation therefore entails the rotation of the blank about a fixed axis and the rotation of the complementarily shaped roller with crowning, with the simultaneous translatory motion of the axis of said roller toward the axis of the blank.

Practical tests have shown that the method according to the invention has achieved the intended aim and object, since it is possible to obtain from sintered blanks a whole range of gear wheels having a modified profile starting from helical cylindrical gear wheels, even gear wheels having a zero helix angle (i.e., with straight teeth).

Accordingly, with a single die and a single range of blanks, simply by varying the complementarily shaped coining rollers, it is possible to obtain a variety of finished products differing in the profile of their teeth.

The invention thus conceived is susceptible of numerous modifications and variations, all of which are within the scope of the inventive concept.

All the details may furthermore be replaced with other technically equivalent elements.

In practice, the materials used, so long as they are compatible with the contingent use, as well as the dimensions, may be any according to requirements.

The disclosures in Italian Patent Application No. PD99A000133 from which this application claims priority are incorporated herein by reference.

What is claimed is:

1. A method for producing gear wheels from blanks obtained by sintering metal powders, comprising the step of:

coining longitudinal and transverse profiles of the teeth of a blank with straight or helical teeth with a rolling operation by means of one or more rollers shaped complementarily to said blank with a profile which is adapted to produce modifications of said longitudinal and transverse profiles.

2. The method according to claim 1, wherein said rolling operation is performed by turning the blank about a fixed axis in mesh with a corresponding complementarily shaped roller which rotates about an axis which is parallel to the axis of said blank and can perform a translatory motion toward said blank.

3. The method according to claim 1, wherein said coining produces a crowning of the longitudinal profile of the teeth.

4. The method according to claim 1, wherein said coining produces a crowning of the transverse profile of the teeth.

* * * * *